US006393044B1

(12) United States Patent
Fishman et al.

(10) Patent No.: US 6,393,044 B1
(45) Date of Patent: May 21, 2002

(54) HIGH EFFICIENCY INDUCTION MELTING SYSTEM

(75) Inventors: Oleg S. Fishman, Maple Glen, PA (US); John H. Mortimer; Joseph T. Belsh, both of Mount Laurel, NJ (US); Richard A. Ranlof, Moorestown, NJ (US); Aurelian Mavrodin, Mount Laurel, NJ (US)

(73) Assignee: Inductotherm Corp., Rancocas, NJ (US)

( * ) Notice: Subject to any disclaimer, the term of this patent is extended or adjusted under 35 U.S.C. 154(b) by 0 days.

(21) Appl. No.: 09/550,305

(22) Filed: Apr. 14, 2000

Related U.S. Application Data

(60) Provisional application No. 60/165,304, filed on Nov. 12, 1999.

(51) Int. Cl.[7] ..... H05B 6/02

(52) U.S. Cl. ..... 373/138; 373/152; 373/156; 373/163

(58) Field of Search ..... 373/5–7, 59, 138, 373/140, 142, 144, 147, 151, 155, 156; 75/10.14; 266/275, 280

(56) References Cited

U.S. PATENT DOCUMENTS 1,842,272 A * 1/1932 Knerr ..... 373/138
2,122,241 A * 6/1938 Arnold ..... 373/142
2,754,347 A * 7/1956 Wroughton et al. ..... 373/155
3,019,275 A * 1/1962 Lorenz ..... 373/138
4,486,889 A * 12/1984 Hegewaldt et al. ..... 373/142
4,618,964 A * 10/1986 Larsson et al. ..... 373/155
5,222,096 A * 6/1993 Reuter ..... 373/143
5,416,795 A * 5/1995 Kaniuk et al. ..... 373/155
5,469,461 A * 11/1995 Andrea ..... 373/156
5,495,495 A * 2/1996 Cullan ..... 373/155
5,559,827 A * 9/1996 Shimada et al. ..... 373/142
5,997,802 A * 12/1999 Holcombe, Jr. et al. .... 266/275

* cited by examiner

*Primary Examiner*—Tu Ba Hoang
(74) *Attorney, Agent, or Firm*—Philip O. Post

(57) ABSTRACT

An induction melting system uses a crucible formed from a material that has a high electrical resistivity or high magnetic permeability and one or more inductor coils formed from a wound cable consisting of multiple individually insulated copper conductors to form an induction furnace that, along with its associated power supply, provides a compact design. The system components are air-cooled; no water-cooling is required. The induction melting system is particularly useful for separating metal from scrap, casting molds directly from the induction furnace, and providing a continuous supply of molten metal.

56 Claims, 14 Drawing Sheets

HIGH EFFICIENCY INDUCTION MELTING SYSTEM

CROSS-REFERENCE TO RELATED APPLICATIONS

This application claims the benefit of U.S. Provisional Application No. 60/165,304 filed on Nov. 12, 1999.

FIELD OF THE INVENTION

The present invention relates to induction melting systems that use magnetic induction to heat a crucible in which metal can be melted and held in the molten state by heat transfer from the crucible.

BACKGROUND OF THE INVENTION

Induction melting systems gain popularity as the most environmentally clean and reasonably efficient method of melting metal. In the induction melting furnace 1 shown in FIG. 1, the electromagnetic field produced by AC current in coil 2 surrounding a crucible 3 couples with conductive materials 4 inside the crucible and induces eddy currents 5, which in turn heat the metal. As indicated in FIG. 1, the arrows associated with coil 2 generally represent the direction of current flow in the coil, whereas the arrows associated with eddy currents 5 generally indicate the opposing direction of induced current flow in the conductive materials. Variable high frequency AC (typically 100 to 10,000 Hz) current is generated in a power supply or in a power converter 6 and supplied to coil 2. The converter 6, typically but not necessarily, consists of an AC-to-DC rectifier 7, a DC-to-AC inverter 8, and a set of capacitors 9, which, together with the induction coil, form a resonance loop. Other forms of power supplies, including motors-generators, pulse-width modulated (PWM) inverters, etc., can be used.

As shown in FIG. 2, the magnetic field causes load current 10 to flow on the outside cylindrical surface of the conductive material, and coil current 11 to flow on the inner surface of the coil conductor as shown in FIG. 2. The crucible 3 in a typical furnace is made from ceramic material and usually is not electrically conductive. The efficiency of the furnace is computed by the formula:

$$\eta = \frac{1}{1 + \frac{D_1}{D_2} \cdot \frac{\rho_1}{\rho_2} \cdot \frac{\Delta_2}{\Delta_1}} \qquad \text{Equation (1)}$$

where $\eta$=furnace efficiency $D_1$=coil inner diameter $D_2$=load outer diameter $\rho_1$=resistivity of coil winding material (copper)

$\rho_2$=resistivity of load (melt)

$\Delta_1$=current depth of penetration in copper winding; and $\Delta_2$=current depth of penetration in load (melt).

The depth of current penetration ($\Delta$) is a function of a material's properties as determined by the formula:

$$\Delta = k \cdot \sqrt{\frac{\rho}{f \cdot \mu}} \qquad \text{Equation (2)}$$

where:

$\rho$=resistivity in ohm·meters;

f=frequency in Hertz;

$\mu$=magnetic permeability (dimensionless relative value);

$\Delta$=depth of penetration in meters.

The constant, 503, in Equation (2) is dimensionless.

Because current does not penetrate deep into the low resistivity copper material of the coil, the typical coil efficiency is about 80 percent when the molten material is iron. Furnaces melting low resistivity materials such as aluminum, (with a typical resistivity value of $2.6\times10^{-8}$ ohm·meters), magnesium or copper alloys have an even lower efficiency of about 65 percent. Because of significant heating due to electrical losses, the induction coil is water-cooled—that is, the coil is made of copper tubes 12 and a water-based coolant is passed through these tubes. The presence of water represents an additional danger when melting aluminum and magnesium and their alloys. In case of crucible rupture, water may get into molten aluminum and a violent chemical reaction may take place in which the aluminum combines with oxygen in the water ($H_2O$), releasing free hydrogen which may cause an explosion. Contact between water and magnesium may similarly result in an explosion and fire. Extreme caution is taken when aluminum or magnesium is melted in conventional water-cooled furnaces.

Often, aluminum scrap is melted in gas-fired furnaces of a sort that are referred to as "stack furnaces." As shown in FIG. 3, a stack furnace 19 consists of two chambers, a dry chamber 20 and a wet chamber 21. The scrap 18 is loaded using a charge transfer bucket 22 that dumps the scrap into the dry chamber 20 as indicated by the arrows in FIG. 3. The scrap is melted by the flame from a gas burner 23. Molten metal runs from a bottom spout 24 of the dry chamber 20 into a bath 25 in the wet chamber 21 where additional heating is provided by a second gas burner 26.

An object of the present invention is to improve the efficiency of an induction furnace by increasing the resistance of the load by using as the load a crucible made of a high temperature electrically conductive material or a high temperature material with high magnetic permeability. It is another object of the present invention to improve the efficiency of an induction furnace by reducing the resistance of the induction coil by using as the coil a cable wound of multiple copper conductors that are isolated from each other. It is still another object of the invention to properly select operating frequencies to yield optimum efficiency of an induction furnace.

It is a further object of the present invention to provide a high efficiency induction melting system with a furnace and power supply that do not use water-cooling and can be efficiently air-cooled. A further objective of the present invention is to use the high efficiency induction melting system of the present invention to melt metal from scrap, cast molds, and provide a continuous source of molten metal for processing, in a manner that is integrated with the induction melting system.

SUMMARY OF THE INVENTION

In its broad aspects, the present invention is an induction furnace that is used for melting a metal charge. The furnace has a crucible formed substantially from a material having a high electrical resistivity or high magnetic permeability, preferably a silicon carbide or a high permeability steel. At least one induction coil surrounds the crucible. The coil consists of a cable wound of a plurality of conductors isolated one from the other. An isolation sleeve electrically and thermally insulates the crucible from the at least one induction coil. Preferably, the isolation sleeve is a composite ceramic material, such as an air-bubbled ceramic between two layers of ceramic.

Copper is especially preferred for the conductors, because of its combination of reasonably high electrical conductivity and reasonably high melting point. An especially preferred form of the cable is Litz wire or litzendraht, in which the individual isolated conductors are woven together in such a way that each conductor successively takes all possible positions in the cross section of the cable, so as to minimize skin effect and high-frequency resistance and distribute the electrical power evenly among the conductors.

In another aspect, the present invention is an induction melting system that is used for melting a metal charge. The system has at least one power supply. The crucible that holds the metal charge is formed substantially from a material having a high electrical resistivity or high magnetic permeability, preferably a silicon carbide or a high permeability steel. At least one induction coil surrounds the crucible. The coil consists of a cable wound of a large number of copper conductors isolated one from the other. An isolation sleeve electrically and thermally insulates the crucible from the at least one induction coil. Preferably, the isolation sleeve is a composite ceramic material, such as an air-bubbled ceramic between two layers of ceramic. Preferably, the induction melting system is air-cooled from a single source of air that sequentially cools components of the power supply and the coil. The metal charge is placed in the crucible. Current is supplied from the at least one power supply to the at least one coil to heat the crucible inductively. Heat is transferred by conduction and/or radiation from the crucible to the metal charge, and melts the charge.

In another aspect, the present invention is an induction melting system for separating metal from scrap metal that contains heavy metal inclusions. The system includes at least one power supply. A dry chamber induction furnace receives and heats the scrap metal. The dry chamber induction furnace includes a crucible for holding the scrap metal. The crucible is formed substantially from a material having a high electrical resistivity or high magnetic permeability, preferably a silicon carbide or a high permeability steel. At least one induction coil surrounds the crucible. The coil consists of a cable wound of multiple conductors, preferably of a magnitude of copper conductors, isolated one from the other. An isolation sleeve electrically and thermally insulates the crucible from the at least one induction coil. Preferably, the isolation sleeve is a composite ceramic material, such as an air-bubbled ceramic between two layers of ceramic. The dry chamber induction furnace includes a means for run out of the molten metal from the furnace, preferably by a trough in the bottom of the furnace. A wet chamber induction furnace receives molten metal by a means for run out from the dry chamber furnace. The wet chamber furnace has a crucible similarly formed from a material of high electrical resistivity or high permeability as the crucible for the dry chamber furnace, at least one induction coil similarly formed as the coil for the dry chamber furnace, and an isolation sleeve similarly situated and formed as for the dry chamber furnace's sleeve. The induction melting system also includes a means for removal of the heavy metal inclusions from the dry furnace induction chamber, preferably by a hinged bottom that can be opened to eject the inclusions. The lid of the dry chamber furnace can include a duct for exhausting fumes created by melting metal in the dry chamber furnace's crucible. A vibratory conveyor can be used to place the scrap metal into the dry furnace's conveyor. Additional wet chamber induction furnaces can be provided with transfer means, preferably a launder system, to selectively transfer the molten metal from the dry chamber furnace to any one of the wet chamber furnaces. Preferably, either the dry chamber or wet chamber furnace is, or both furnaces are, air-cooled from a single source of air that sequentially cools components of the at least one power supply and the at least one induction coil associated with either the dry chamber or wet chamber furnace, or both furnaces. Metal scrap is placed in the dry chamber crucible of the dry chamber induction furnace. Current is supplied from the at least one power supply to the at least one induction coil surrounding the dry chamber crucible to inductively heat the crucible. Heat is transferred from the crucible to the metal scrap, which produces a molten metal that runs out of the dry chamber crucible and selectively into one of the wet chamber crucibles of the wet chamber induction furnaces. Current is supplied from the at least one power supply to the at least one induction coil surrounding appropriate ones of the wet chamber crucibles to inductively heat the crucibles. Heat is transferred from the crucibles to the molten metal in the crucibles. One or more of the wet chamber crucibles can be removed from their associated wet chamber induction furnaces.

In another aspect, the present invention is an induction furnace for casting a mold from a molten metal. The system has at least one power supply. A sealed crucible holds and heats the molten metal. The crucible is formed substantially from a material having a high electrical resistivity or high magnetic permeability, preferably a silicon carbide or a high permeability steel. At least one induction coil surrounds the crucible. The coil consists of a cable wound of a magnitude of copper conductors isolated one from the other. An isolation sleeve electrically and thermally insulates the crucible from the at least one induction coil. Preferably, the isolation sleeve is a composite ceramic material, such as an air-bubbled ceramic between two layers of ceramic. A suitable but not limiting selection for the ceramic compositions is an alumina or silica based ceramic. A tube, preferably with a flanged end external to the crucible, penetrates the seal of the crucible and is partially immersed in the molten metal bath. A mold is aligned on top of the flanged end of the tube so that its gate is coincident with the opening in the tube. A port is provided in the sealed crucible for the connection of a supply of controlled pressurized gas to the interior of the crucible. Preferably, the induction furnace is air-cooled from a single source of air that sequentially cools components of the power supply and the coil. Molten metal is placed inside the crucible and the crucible is sealed. Current is supplied from the at least one power supply to the at least one coil to inductively heat the crucible. Heat is transferred from the crucible to the molten metal to keep the metal molten. Pressurized gas is injected into the sealed chamber via the gas port to pressurize the interior of the crucible and force molten metal through the tube and into the mold cavities. When the mold is filled with molten metal, the interior of the crucible is depressurized and the mold is removed from the flanged end of the tube.

In still another aspect, the present invention is an induction melting system for providing a continuous supply of molten metal. The system has at least one power supply. A sealed crucible holds and heats the molten metal. The crucible is formed substantially from a material having a high electrical resistivity or high magnetic permeability, preferably a silicon carbide or a high permeability steel. At least one induction coil surrounds the crucible. The coil consists of a cable wound of a magnitude of copper conductors isolated one from the other. An isolation sleeve electrically and thermally insulates the crucible from the at least one induction coil. Preferably, the isolation sleeve is a composite ceramic material, such as an air-bubbled ceramic between two layers of ceramic. An inlet conduit has a receiver end external to the sealed crucible and an opposing end internal to the sealed crucible. The opposing end is immersed in the molten metal bath. An outlet conduit protrudes through the sealed crucible and has one end immersed in the molten metal bath and an opposing exit end that is external to the crucible. A port is provided in the sealed crucible for the connection of a supply of controlled pressurized gas to the interior of the crucible. Preferably, the induction furnace is air-cooled from a single source of air that sequentially cools components of the power supply and the coil. Furnace feed material is continuously supplied to the crucible at the receiver end of the inlet conduit. Feed material is continuously heated by heat transfer from the crucible, which is inductively heated by the at least one induction coil surrounding the crucible. Pressurized gas is injected into the sealed chamber via the port to pressurize the interior of the crucible and continuously force molten metal through the outlet conduit to its exit end. The outlet conduit may be a siphon, which can maintain a continuous flow of molten metal from the crucible without the requirement for maintaining a continuous positive pressure in the interior of the crucible. A gas port may be provided in the siphonal outlet conduit for the injection of a gas into the outlet conduit to break the continuous flow of molten metal.

These and other aspects of the invention will be apparent from the following description and the appended claims.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 5(*b*) is a cross sectional view of the wound cable shown in FIG. 5(*a*).

FIG. 5(*c*) is a cross sectional view of one of the insulated copper conductors that make up the wound cable.

FIG. 6(*b*) is a cross sectional detail of one embodiment of the isolation sleeve shown in FIG. 6(*a*).

FIG. 6(*c*) illustrates the airflow through the power supply and induction coil for the induction melting system of the present invention.

FIG. 8(*b*) is a perspective view of one embodiment of the bottom of the dry chamber furnace used with the induction melting system of the present invention.

FIG. 8(*c*) is a cross sectional perspective view of the bottom of the dry chamber furnace as indicated by section line A—A in FIG. 8(*b*).

DETAILED DESCRIPTION OF THE INVENTION

Figure 4:
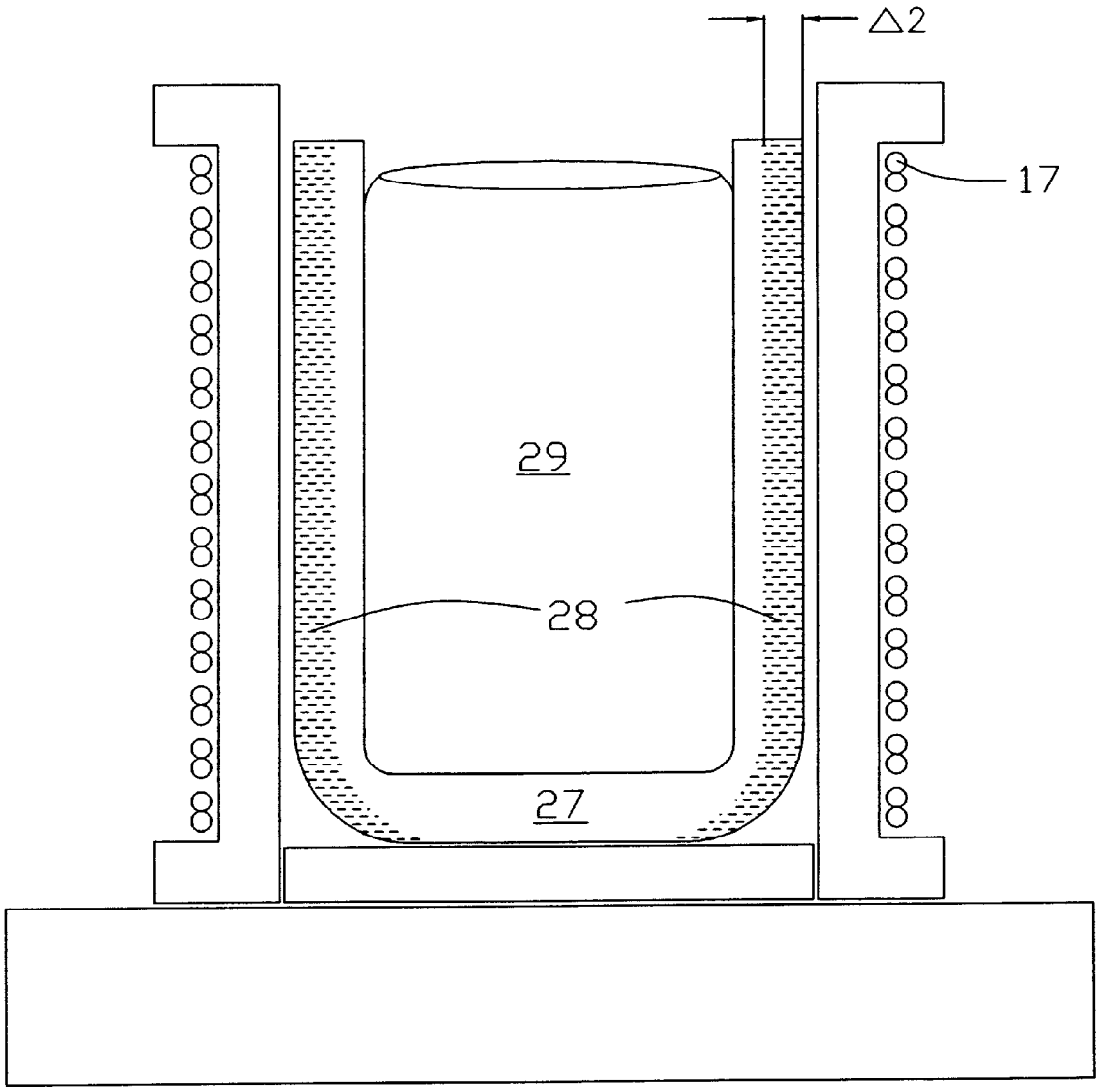
FIG. 4 is a cross sectional elevation view showing the distribution of current in an electrically conductive high resistance crucible used in the induction furnace of the present invention.

The efficiency of an induction furnace as expressed by Equation (1) and Equation (2) can be improved if the resistance of the load can be increased. The load resistance in furnaces melting high conducting metals such as aluminum, magnesium or copper alloys may be increased by coupling the electromagnetic field to the crucible instead of to the metal itself. The ceramic crucible may be replaced by a high temperature, electrically conductive material with high resistivity factor. Silicon carbide (SiC) is one of the materials that has these properties, namely a resistivity generally in the range of 10 to $10^4$ ohm·meters. Silicon carbide compositions with resistivity in the approximate range of 3,000 to 4,000 ohm·meters are particularly applicable to the present invention. Alternatively, the crucible may be made from steel. For example, there are high permeability ferromagnetic steels with permeabilities in the range of 5,000. In this case, rather than relying on high resistivity, the high permeability will result in low depth of current penetration. FIG. 4 shows the distribution of current 28 in the crucible 27 that will produce the effect of high total resistance. The best effect is achieved when the wall thickness of the crucible is about 1.3 to 1.5 times larger than the depth of current penetration into the crucible. In this case, the shunting effect of highly conductive molten metal 29 is minimized.

Figure 1:
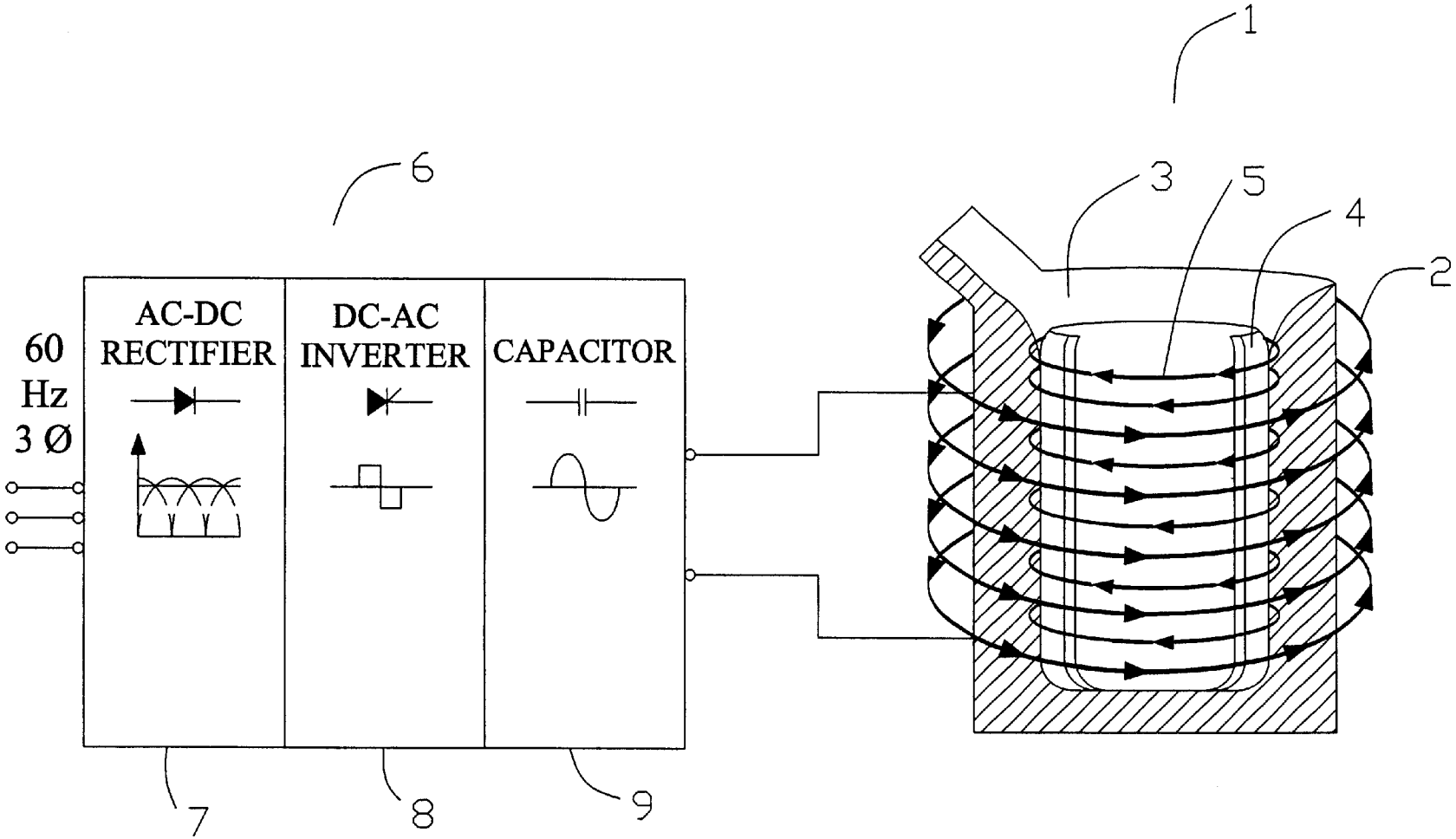
FIG. 1 PRIOR ART
FIG. 1 is a diagrammatic representation of an induction melting system that includes a furnace and power supply converter.
Figure 2:
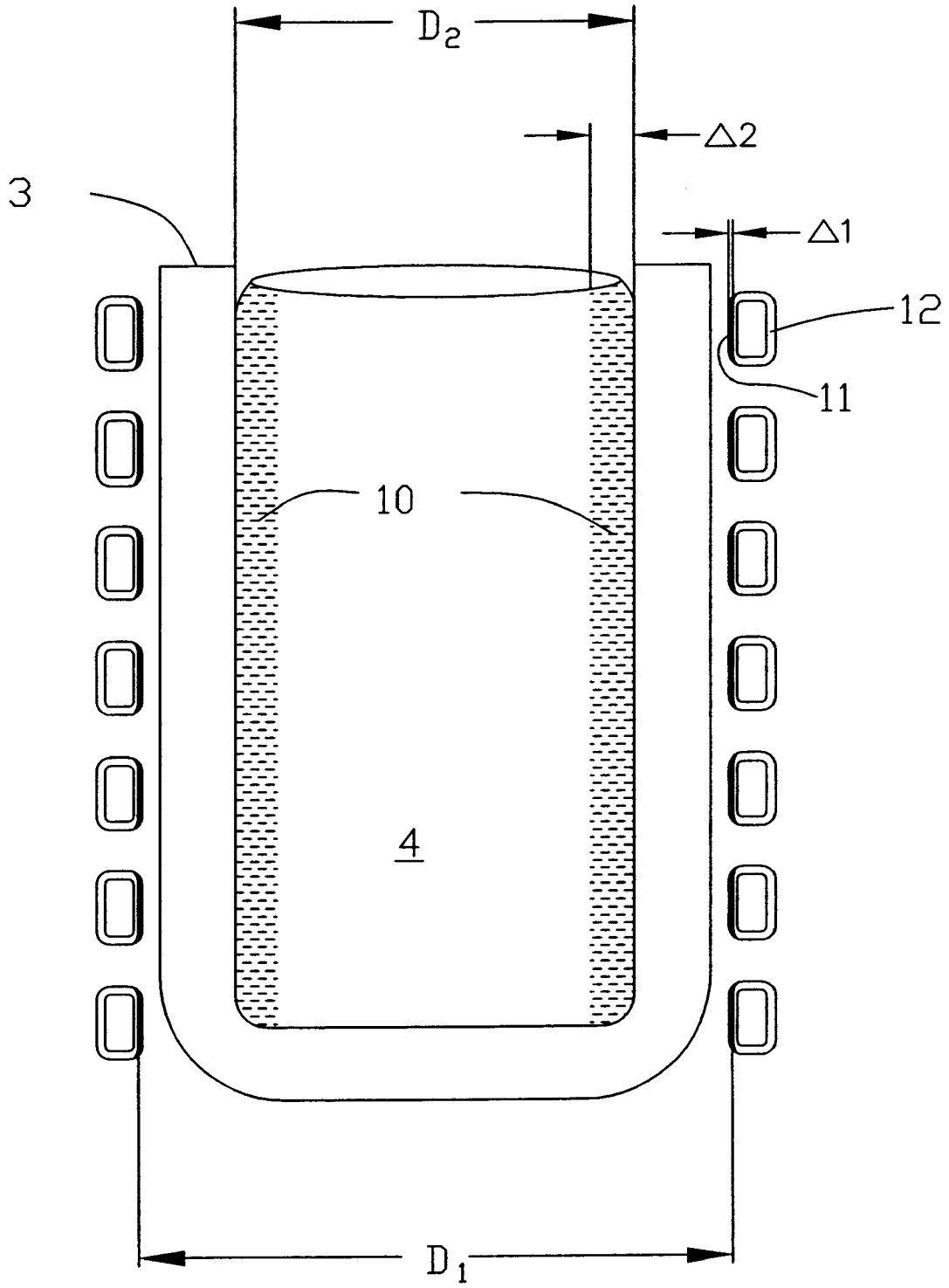
FIG. 2 PRIOR ART
FIG. 2 is a cross sectional elevation view of an induction coil of copper tubes around a crucible that has a conductive material inside of the crucible.
Figure 3:
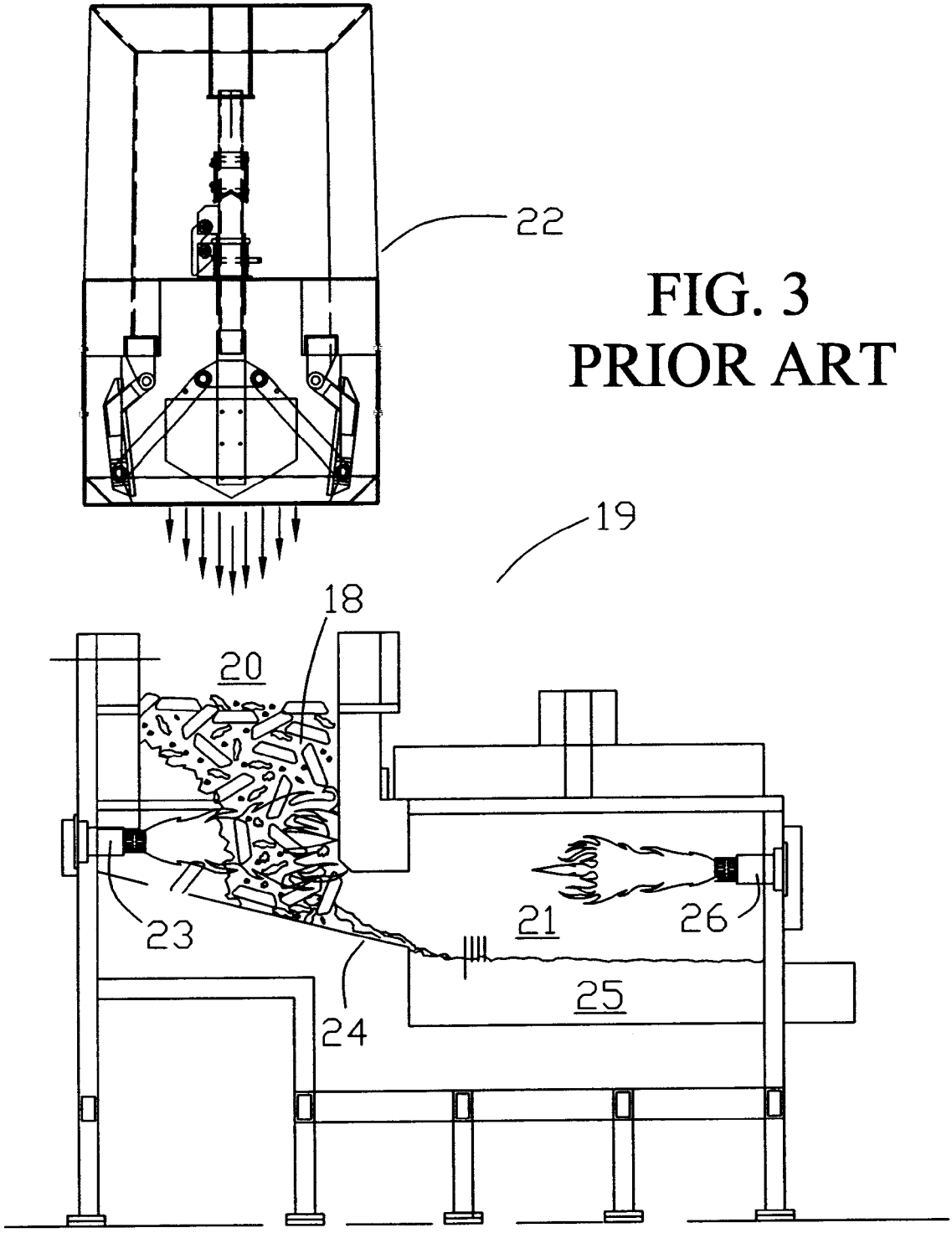
FIG. 3 PRIOR ART
FIG. 3 is a cross sectional elevation view of a stack furnace showing dry and wet chambers, and the charge transfer bucket used to dump scrap into the dry chamber.
Figure 5A:
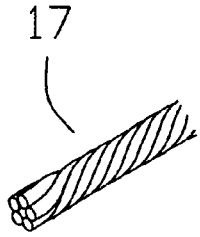
FIG. 5(*a*) is a perspective view of a wound cable composed of twisted multiple copper conductors that is used in the induction furnace of the present invention.
Figure 5B:
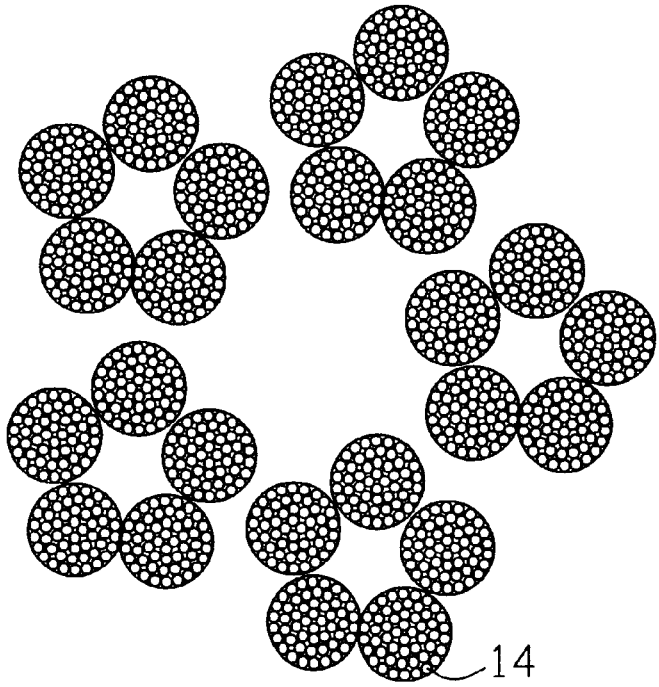
Figure 5C:
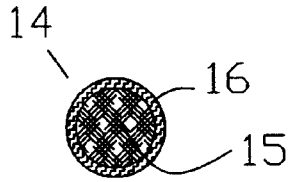

An additional improvement in the efficiency of an induction furnace can be achieved by reducing the resistance of the coil. High conductivity copper is widely used as the material for a coil winding. However, because of the high conductivity (low resistivity) of the copper, the current is concentrated in a thin layer of coil current 11 on the surface of the coil facing the load, as shown in FIG. 2. The depth of current penetration is given by Equation (2). Because the layer is so thin, especially at elevated frequencies, the effective coil resistance may be considerably higher than would be expected from the resistivity of copper and the total cross-sectional area of the copper coil. That will significantly affect the efficiency of the furnace. Instead of using a solid tubular conductor, one embodiment of the present invention uses a cable 17 wound of a large number of copper conductors isolated one from another, as shown in FIGS. 5(*a*), 5(*b*) and 5(*c*). One of the insulated copper conductors 14 is shown in FIG. 5(*c*) with the insulation 16 that isolates the copper conductor 15 from surrounding conductors. The cable 17 is of the sort known in the electronic industry as Litz wire or litzendraht. It assures equal current distribution through the copper cross section when the diameter of each individual copper wire strand is significantly smaller than the depth of current penetration $\Delta_1$ as given by Equation (2). For the present application, a suitable but not limiting number of strands in approximately between 1,000 and 2,000. Other variations in the configuration of the Litz wire will perform satisfactory without deviating from the present invention.

The proper selection of operating frequencies yields optimum efficiency of an induction furnace. The criteria for frequency selection are based on depth of current penetration in the high resistance crucible and copper coil. The two criteria are:

$$\Delta_1 >> d_1;$$

and $$\Delta_2 \approx 1.2 d_2$$

where:

$d_1$=diameter of a strand of Litz wire; and $d_2$=wall thickness of the crucible.

For example, when the copper strand diameter is $d_1$=0.01 inch and the silicon carbide wall is $d_2$=2.0 inches, the optimal frequency is 3,000 Hz. With this selection, the relative electrical losses in the coil may be reduced to about 2.2%, which is more than 15 times better than a standard induction furnace.

Acceptable, but not limiting, parameters for a furnace in accordance with the present invention is selecting $d_1$ in the range of 0.2 to 2.0 meters, $d_2$ in the range of 0.15 to 1.8 meters, and frequency in the range of 1,000 to 5,000 Hertz.

Such an increase in efficiency or reduction in coil losses, and thus reduction in heating of the coil, eliminates the need for a water-based cooling system. Instead, a reasonable airflow through the induction coil is sufficient to remove the heat generated by the coil. The furnace crucible should be well insulated from the coil to minimize thermal losses and heating of the copper winding due to thermal conduction.

Figure 6A:
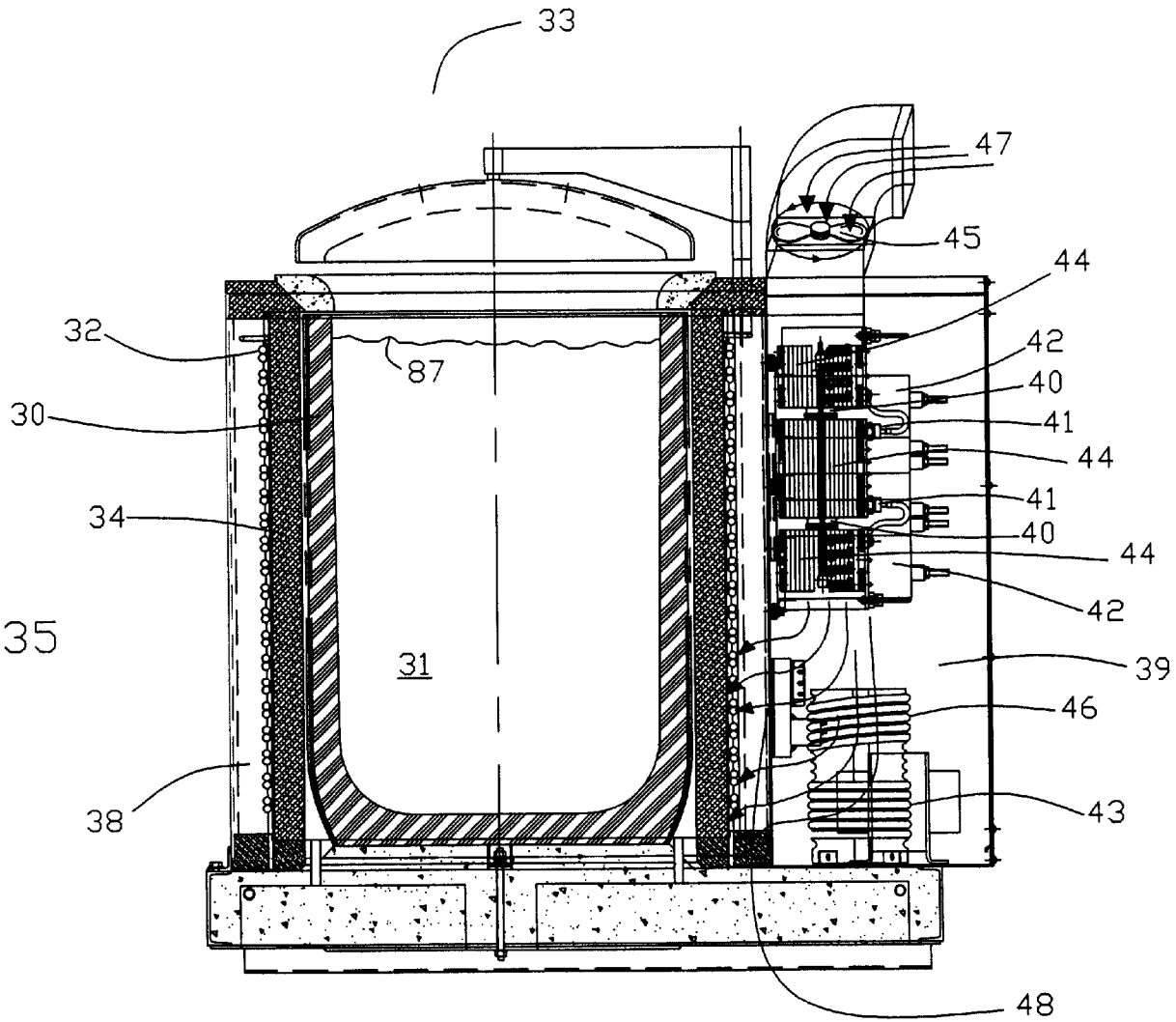
FIG. 6(*a*) is a cross sectional elevation view of an induction furnace of the present invention with a high electrical resistance crucible and an induction coil of the wound cable shown in FIG. 5(*a*).
Figure 6B:
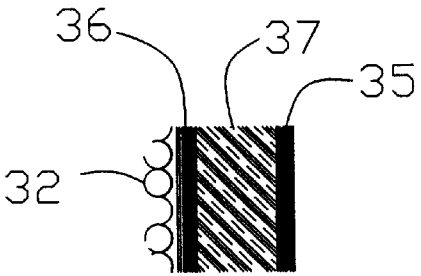
Figure 6C:
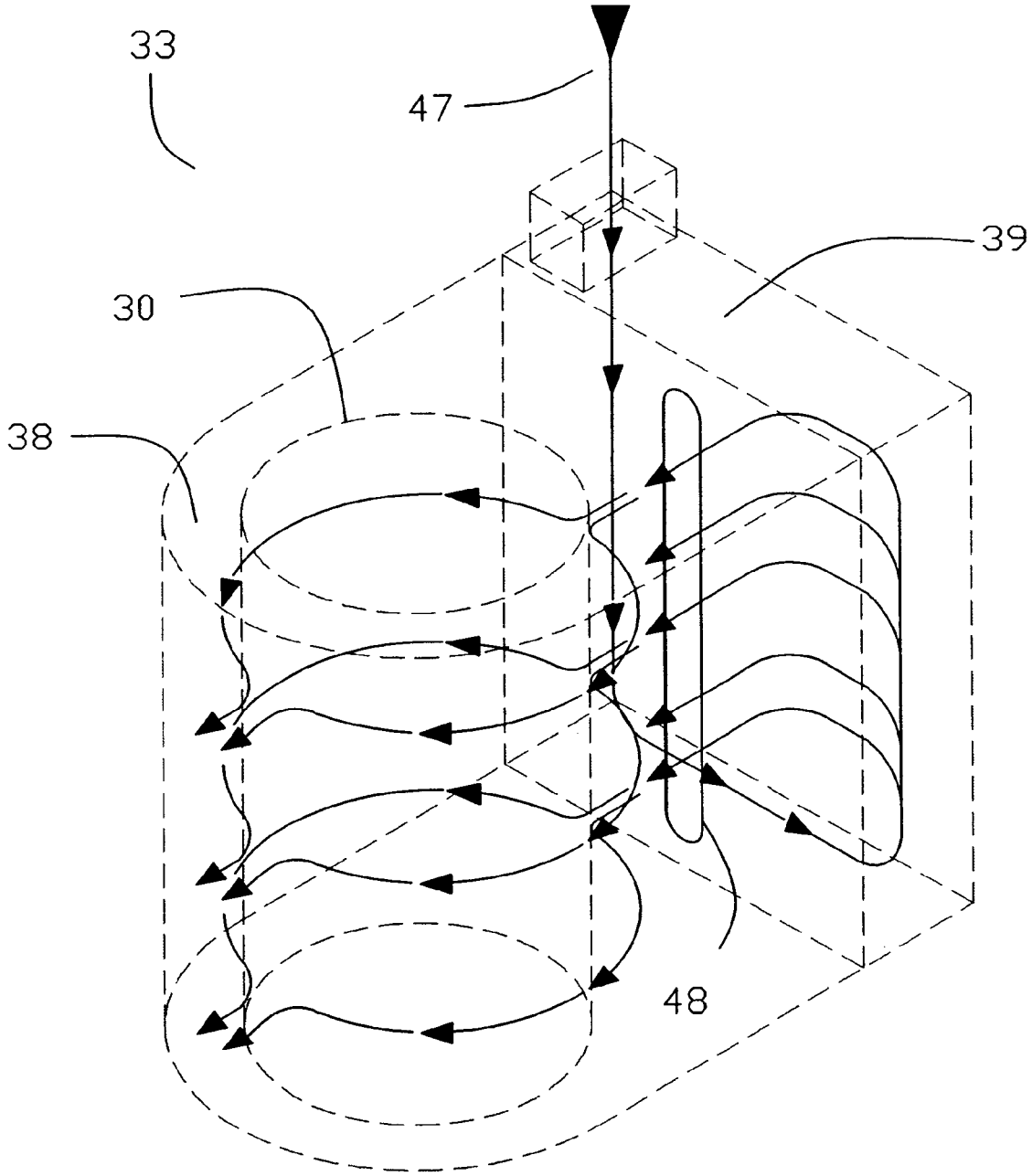

Referring now to the drawings, wherein like numerals indicate like elements, there is shown in FIG. 6(*a*) an embodiment of a high-efficiency induction melting system 33 in accordance with the present invention. The induction melting system 33 includes a high electrical resistance or high magnetic permeance crucible 30 containing metal charge 31. The high resistance or high permeance is achieved by using a crucible made from a high resistivity material (p>2500 $\mu\Omega$·cm) like silicon carbide or from a high permeability steel ($\mu$>20), respectively. The selection of crucible material depends on the properties of the metals to be melted. For aluminum or copper alloys, silicon carbide is a better crucible material, while for magnesium or magnesium alloys, steel may be a better choice for the crucible material. The crucible 30 is heated by the magnetic field generated by current in the coil 32, which is made with Litz wire. The hot crucible is insulated from the coil electrically and thermally by an isolation sleeve 34. The isolation sleeve is constructed from a high strength composite ceramic material containing one or more inner layers 35 and outer layers 36 filled with air-bubbled ceramic 37 with good thermal insulation properties. The honeycomb structure of the isolation sleeve provides necessary strength and thermal isolation. The electrically insulating nature of the isolation sleeve, together with its low magnetic permeability, ensures that no appreciable inductive heating takes place in the isolation sleeve itself. That concentrates the heating in the crucible 30, inside the thermal insulation of the isolation sleeve 34, which both improves the efficiency of the induction melting system 33 and reduces heating of the coil 32.

Figure 7:
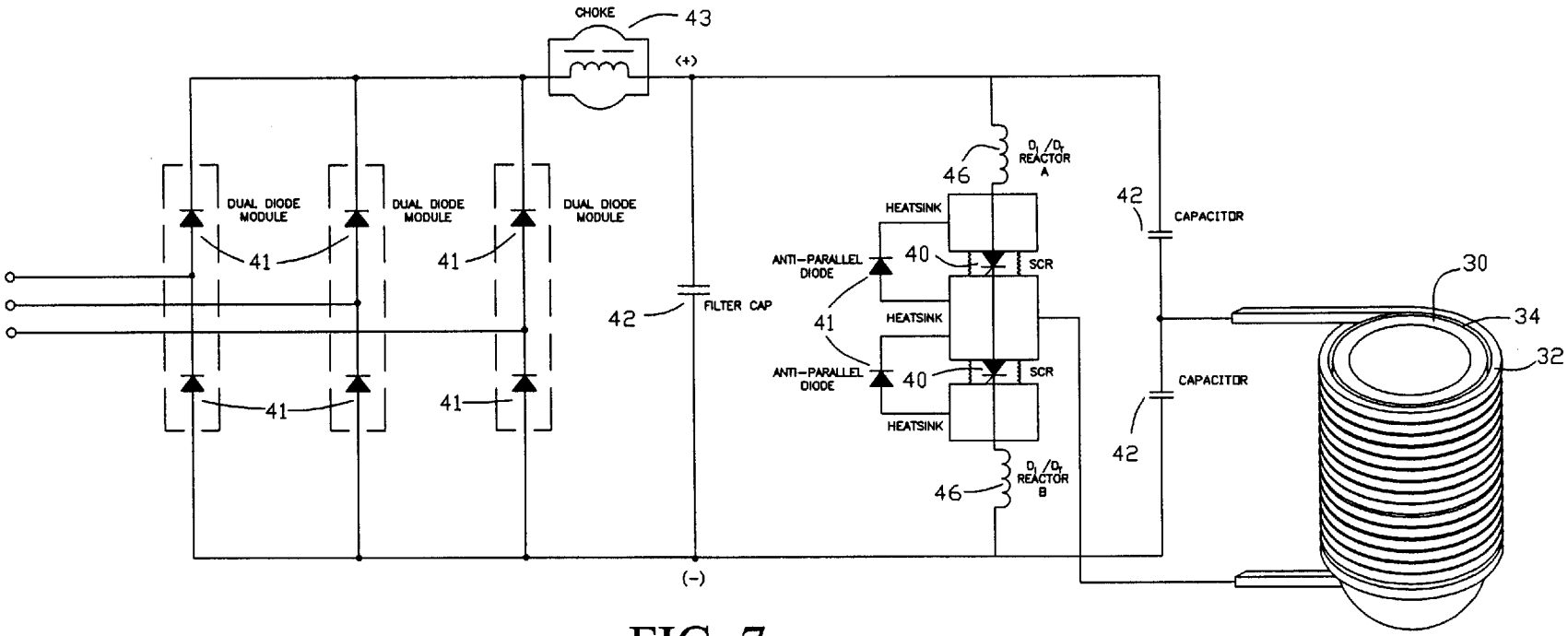
FIG. 7 is an electrical schematic of the power circuit for one embodiment of the induction melting system of the present invention.

One embodiment of the invention includes a power converter 39 that converts a three-phase standard line voltage such as 220, 280 or 600 volts into a single phase voltage with a frequency in the range of 1,000 to 3,000 Hz. The power converter may include power semiconductor diodes 41, silicon controlled rectifiers (SCR) 40, capacitors 42, inductors 43 and 46, and control electronics. The schematic diagram of one implementation of the power converter is shown in FIG. 7. All of the semiconductor components of the power converter are air-cooled via heat exchangers 44. Other inverter circuits and even electromechanical systems can be used.

In one embodiment of the invention, the power converter 39 is mounted adjacent to the induction coil 32. As shown in FIG. 6(*a*) and FIG. 6(*c*), an airflow 47 (as illustrated by arrows from an external blower 45) is fed to the power converter where the cold air first cools the semiconductors' heat exchangers 44, and then the capacitors, inductors and other passive components. The converter cabinet is positively pressurized to prevent foundry dust from entering the electronics compartments. The airflow exits through a slot 48 in the back wall of the power supply 39 and enters and flows through the coil chamber 38 to remove heat from the coil. In FIG. 6(*c*), for clarity in illustrating the airflow 47 through the induction melting system, the induction melting system 33 is outlined in phantom.

Figure 8A:
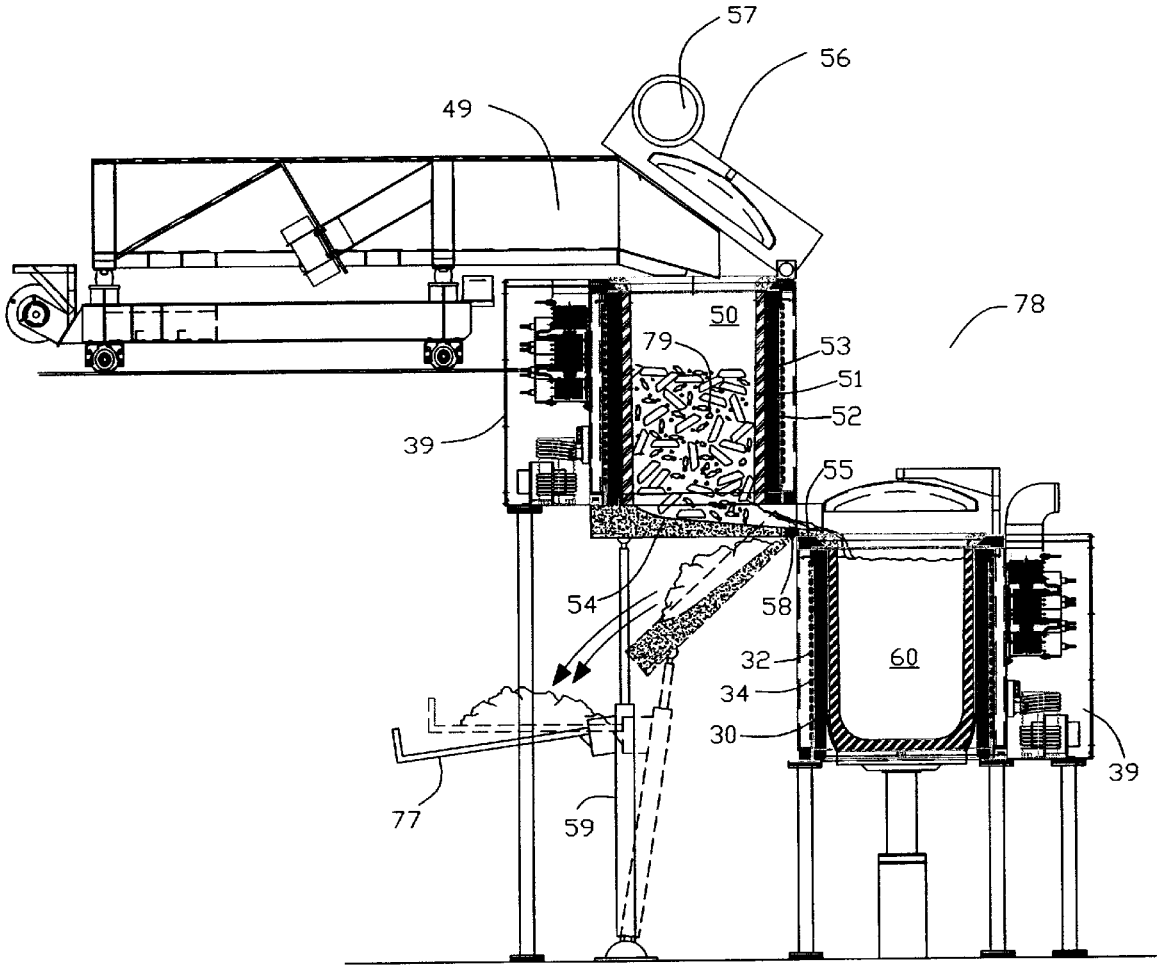
FIG. 8(*a*) is a cross sectional elevation of an induction melting system of the present invention for separating metal from scrap metal.
Figure 8B:
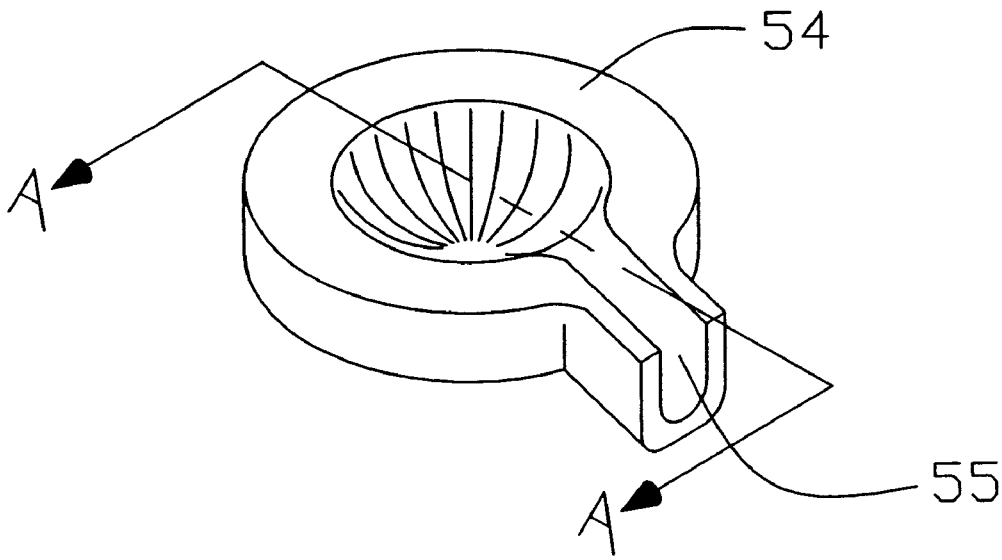
Figure 8C:
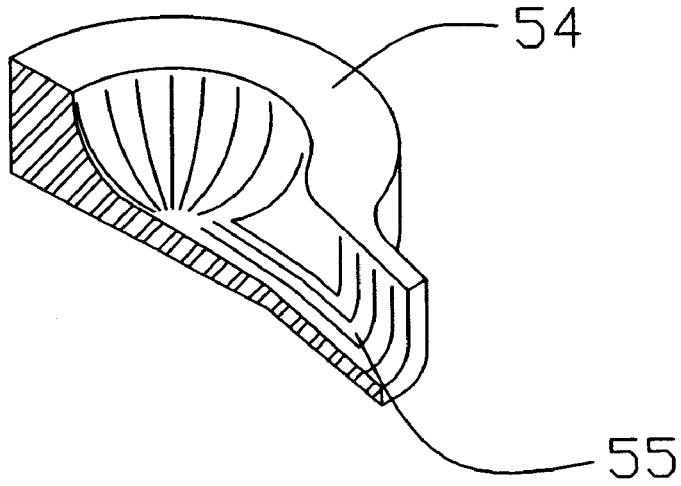

To melt contaminated scrap 79, another embodiment of the invention comprises an induction scrap furnace 78 that combines two inductively heated crucible furnaces, one forming a dry chamber 50 and one forming a wet chamber 60, as shown in FIG. 8(*a*). Selected components of the dry chamber furnace are similar to those for the melting induction system shown in FIG. 6(*a*). For example, the dry chamber consists of high resistance electrically conductive walls 51 that are inductively heated by current in an external low resistance Litz wire coil 52. The walls of the chamber are thermally and electrically isolated from the coil by a ceramic sleeve 53. Unlike the melting induction system shown in FIG. 6(*a*), the bottom 54 of the dry chamber contains a trough 55 (most clearly seen in FIG. 8(*b*) and FIG. 8(*c*)) through which molten metal can run out from the dry chamber into the wet chamber 60.

Aluminum scrap, which may have heavy metal inclusions such as iron or steel (typical when remelting aluminum engine blocks with steel sleeve inserts), is charged with the help of a vibratory conveyor 49 into the open hearth of the dry chamber. An inclined lid 56 of the furnace is provided with an exhaust duct 57. Since the induction stack furnace 78 does not burn fuel, the only contaminants are those that were in the scrap. Therefore, fumes may be easily removed by an exhaust system (not shown in the drawings) connected to the exhaust duct 57 in the furnace lid 56.

The aluminum scrap 79 is heated via radiation from the dry chamber walls 51. The metal scrap 79 moves toward the bottom as the charge loaded previously overheats and melts.

The molten metal runs via a trough 55 in the bottom into the wet chamber 60. The unmelted remnant of steel inclusions and nonmetallic dross stays on the dry chamber bottom 54.

In yet another embodiment of the invention, the bottom 54 of the dry chamber is hinged around a hinge 58. A cylinder 59 supporting the dry chamber can tilt the bottom for removal of the dross and heavy steel remnants into a slag bin 77. The slag bin 77 and cylinder 59 are shown in phantom in FIG. 8(*a*) to indicate their positions when the bottom 54 is open. The wet chamber 60 is similar to the inductively heated crucible furnace previously described.

Figure 9:
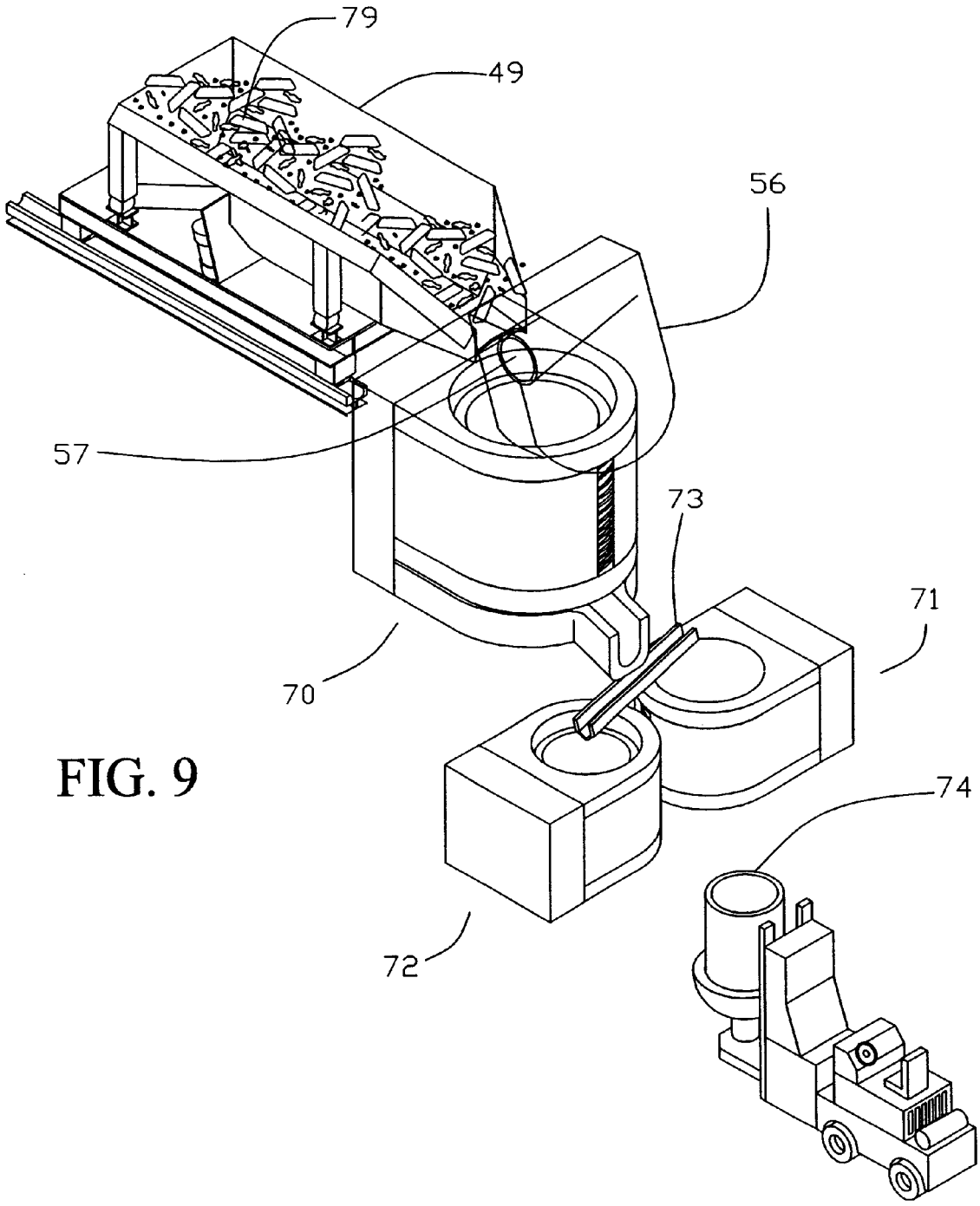
FIG. 9 is a perspective view of an induction melting system of the present invention for separating metal from scrap metal wherein two wet furnace chambers are provided to store the molten metal and the crucibles in the wet furnace chambers are portable.

FIG. 9 shows another embodiment of the invention, in which one dry chamber furnace 70 of an induction stack furnace can be connected to two wet chamber furnaces 71 and 72. A tiltable launder 73 directs the flow of metal out of the dry chamber into either of the wet chambers. The chambers are constructed in such a way that a crucible 74 with molten metal may be removed from a wet-chamber induction furnace by dropping the crucible or lifting the furnace coil. The crucibles with molten metal may be delivered to casting stations around the plant or even tracked by road to other plants. Therefore, a continuous supply of molten metal may be provided through the dry chamber furnace 70, while the metal is distributed in crucibles.

Figure 10:
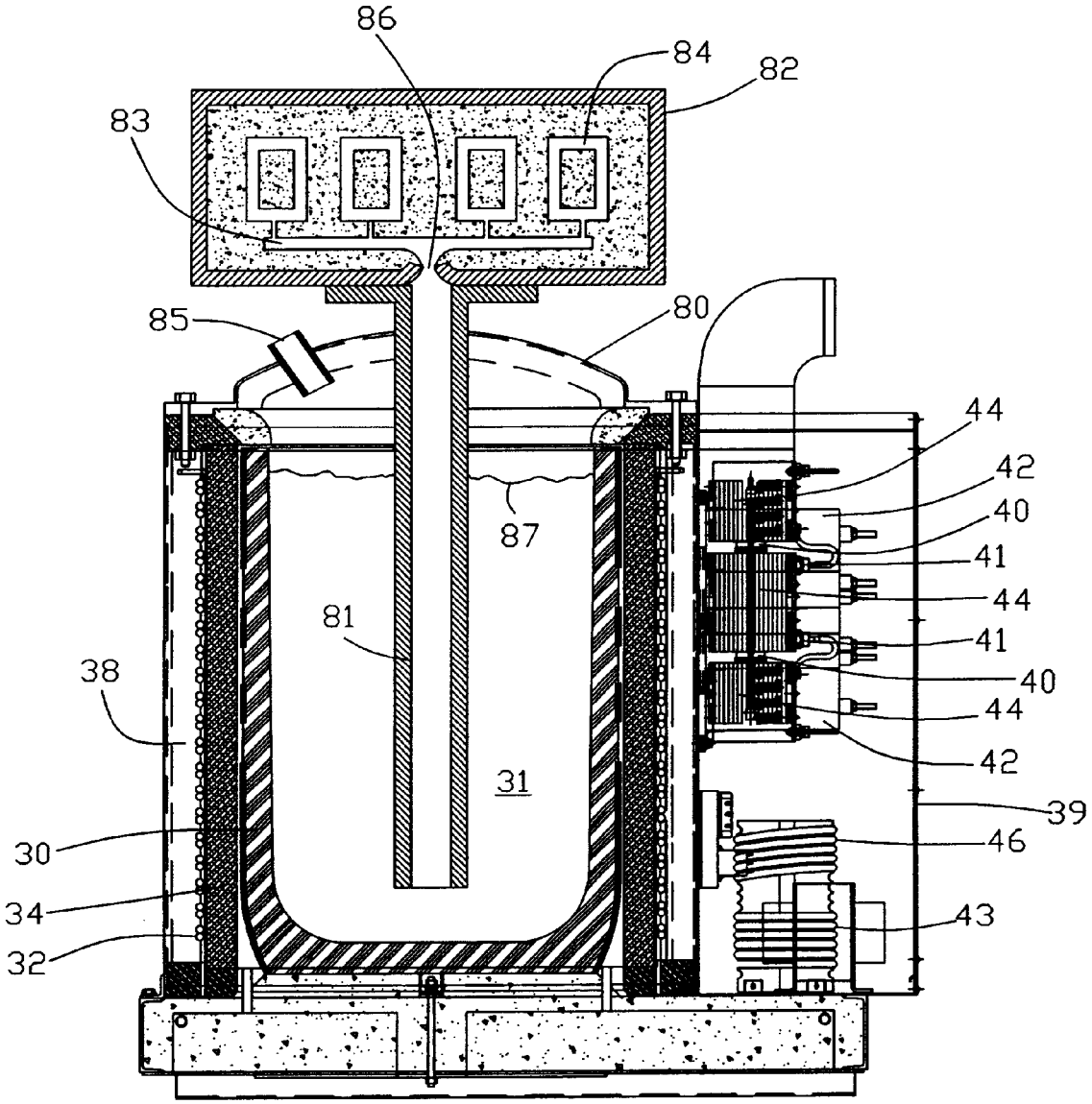
FIG. 10 is a cross sectional elevation view of an induction melting system of the present invention for casting molds.

FIG. 10 shows another embodiment of an induction melting system of the present invention. In this embodiment the furnace is covered with a tight lid 80, through which a high temperature tube 81 protrudes into the molten bath. At the other end, the tube 81 is flanged to a mold 82, which may be a permanent mold or a sand mold, with feeder gates 83 inside the mold connecting to the tube. Pressurized gas is injected by a port 85 into the furnace between the lid 80 and bath surface 87. Excess pressure forces the molten metal 31 up the casting tube 81 and injects molten metal into the cavities 84 of the mold. A narrow gate 86 between the mold and the casting tube freezes before the mold can be removed from the flange. The furnace depressurizes and excess metal in the tube is returned into the molten bath. To refill the furnace with molten metal the lid 80 can be lifted.

Figure 11:
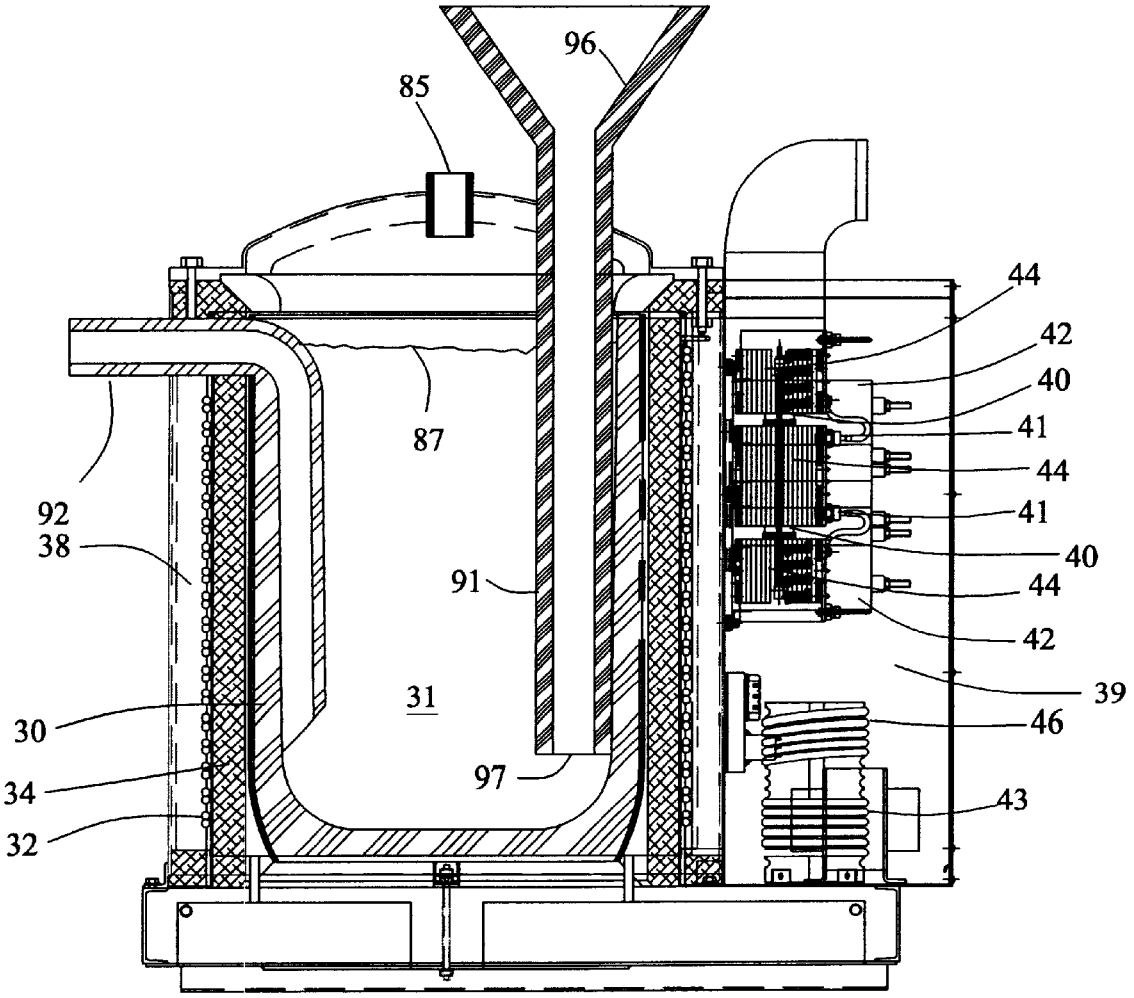
FIG. 11 is a cross sectional elevation view of an induction melting system of the present invention for providing a continuous supply of molten metal.

The induction melting system of the present invention can be used to provide a supply of continuous molten metal from the induction furnace. As shown in FIG. 11, furnace feed material is placed in a receiver 96 of a high temperature inlet conduit 91. The exit end 97 of the inlet conduit 91 (opposite the receiver 96) is situated below the surface of the molten metal bath 87, and is preferably adjacent to a wall of the crucible 30 to achieve a high heat transfer rate from the crucible wall to the input conduit. Feed material, depending upon the particular furnace design and operating conditions, can range from impure solid metal to a metal slurry or molten metal at lower temperatures. Furnace feed material will travel through the inlet conduit 91 to its exit end 97 and into the crucible 30 where it is further melted and mixed with the existing molten metal 31.

Figure 12:
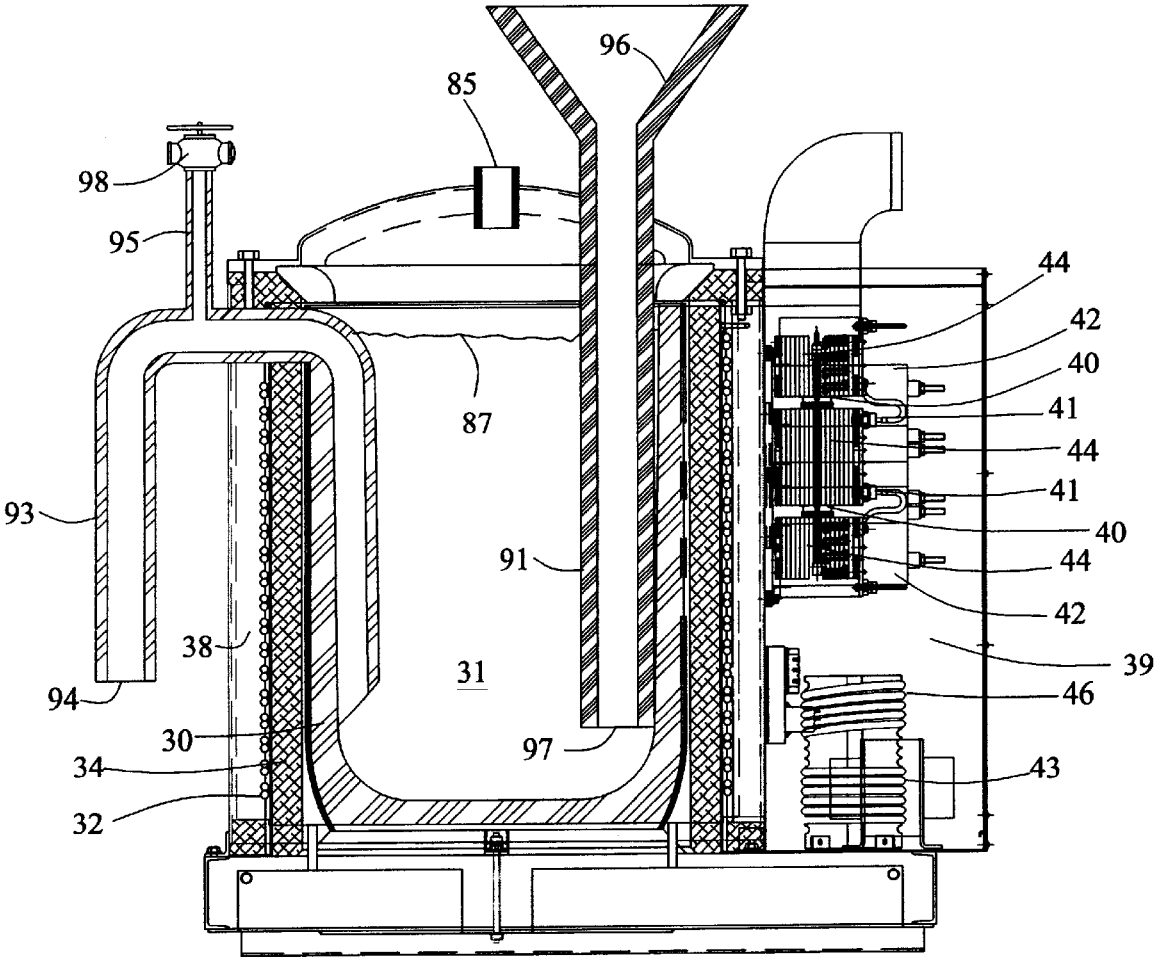
FIG. 12 is a cross sectional elevation view of an induction melting furnace of the present invention for providing a continuous supply of molten metal wherein the molten metal is siphoned from the crucible.

A high temperature outlet conduit 92 provides a continuous means of drawing molten metal from the crucible 30. As shown in FIG. 11 and FIG. 12, a portion of the outlet conduit comprises the crucible's inner wall. A conduit totally separate from the inner wall can also be used. Controlled pressurized gas from a suitable source (not shown in the drawings) is injected into the enclosed volume defined by the crucible and lid components and the surface of the molten metal bath via a port 85. The gas maintains a positive pressure on the bath to force molten metal out of the crucible through the outlet conduit 92.

In an alternative embodiment shown in FIG. 12, an outlet conduit 93 forms a siphon that will enable the induction melting system to provide a continuous flow of molten metal from the crucible 30 through the exit 94 of the outlet conduit without the necessity of continuous gas pressurization via the port 85. The exit 94 of the outlet conduit 93 can be aligned with an indexing mold line, transport crucibles, or other such vessels to receive the molten metal as it exits from the outlet conduit. A port 95 can be provided for the injection of a sufficient volume of gas at a pressure into the outlet conduit 93 to create a gas break in the continuous flow of molten metal. A valve 98 can be used to control the flow of gas into the outlet conduit. One of the two discontinuous terminated streams of molten metal will drain back into the crucible while the other drains out of exit port 94. When a continuous flow of molten metal flows from the outlet conduit a small positive pressure can be maintained at the inlet of port 95 into the outlet conduit 93. A particular advantage to the siphon and gas break to stop the flow in this application is that it avoids the use of in-line mechanical pumps and valves, which would be subject to rapid failures due to the freezing of the molten metal during pumping and flow interruption.

The foregoing embodiments do not limit the scope of the disclosed invention. The scope of the disclosed invention is covered in the appended claims.

What is claimed is:

1. An induction furnace for melting a metal charge, comprising:

a crucible for holding said metal charge, said crucible formed substantially from a material selected from the group consisting of silicon carbides, high electrical resistivity steels and high permeability steels;

at least one induction coil comprising a cable wound of a plurality of conductors isolated one from the other, said at least one induction coil surrounding said crucible; and an electrically and thermally insulating isolation sleeve of low magnetic permeance separating said crucible from said at least one induction coil.

2. An induction furnace for melting a metal charge, comprising:

a crucible for holding said metal charge, said crucible formed substantially from a material having a high electrical resistivity or high magnetic permeability;

at least one induction coil comprising a cable wound of a plurality of conductors isolated one from the other, said at least one induction coil surrounding said crucible; and an electrically and thermally insulating isolation sleeve of low magnetic permeance separating said crucible from said at least one induction coil wherein said isolation sleeve comprises an air-bubbled ceramic disposed between at least one inner and at least one outer layer of ceramic.

3. The induction furnace of claim 1 wherein said isolation sleeve comprises a composite ceramic material.

4. The induction furnace of claim 3 wherein said composite ceramic material comprises an air-bubbled ceramic disposed between at least one inner and at least one outer layer of ceramic.

5. An induction melting system for melting a metal charge comprising:

at least one power supply comprising an inverter arranged to provide AC electric power of a selected frequency;

a crucible for holding said metal charge, said crucible formed substantially from a material having a high electrical resistivity or high magnetic permeability;

at least one induction coil consisting of a cable wound of a plurality of conductors isolated one from the other, said at least one induction coil surrounding said crucible; and an isolation sleeve to electrically and thermally isolate said crucible from said at least one induction coil;

wherein the depth of penetration into said crucible of a magnetic field generated by a current of the selected frequency in said at least one induction coil is in the range of from half the thickness to die thickness of the crucible;

whereby the magnetic field generated by said current in said at least one induction coil is inductively coupled to said crucible to heat said crucible with heat transfer from said crucible melting said metal charge.

6. The induction melting system of claim 5, wherein said crucible is formed substantially from a silicon carbide or a high permeability steel.

7. The induction melting system of claim 5 wherein said isolation sleeve is a composite ceramic material.

8. The induction melting system of claim 7 wherein said composite ceramic material comprises an air-bubbled ceramic disposed between an inner and an outer layer of ceramic.

9. The induction melting system of claim 5 wherein said at least one power supply and said at least one induction coil are air cooled.

10. The induction melting system of claim 5 wherein said at least one power supply is mounted adjacent to said at least one induction coil.

11. The induction melting system of claim 10 wherein an airflow sequentially cools components of said at least one power supply and said at least one induction coil.

12. The induction melting system of claim 5 wherein the selected frequency of said at least one power supply results in the depth of penetration into said crucible of the magnetic field being approximately equal to 1.2 times the thickness of the crucible.

13. A method of melting a metal charge comprising the steps of:

placing said metal charge in a crucible formed substantially from a material of high electrical resistivity or high magnetic permeability;

inductively heating said crucible by supplying a current of a selected frequency to at least one induction coil consisting of a cable wound of multiple conductors isolated one from the other, said at least one induction coil surrounding said crucible and being electrically and thermally isolated from said crucible; and melting said metal charge by the conduction of heat from said crucible to said metal charge;

wherein the depth of penetration into the crucible of the magnetic field generated by said current in said at least one induction coil is in the range of from half the thickness to the thickness of the crucible.

14. An induction melting system for separating a metal from a scrap metal containing heavy metal inclusions comprising:

at least one power supply;

a dry chamber induction furnace for receiving and heating said scrap metal to produce a molten metal, said dry chamber induction furnace further comprising:

a dry chamber crucible for holding and heating said scrap metal, said crucible formed substantially from a material having a high electrical resistivity or having a high magnetic permeability to limit the penetration depth of a dry chamber material current into said dry chamber crucible;

at least one dry chamber induction coil consisting of a cable wound of conductors isolated one from the other, said at least one dry chamber induction coil surrounding said dry chamber crucible; and an isolation sleeve to electrically and thermally insulate said dry chamber crucible from said at least one dry chamber induction coil; whereby a dry chamber magnetic field is generated by a first current in said at least one dry chamber induction coil; the at least one dry chamber induction coil connected to said at least one power supply; the dry chamber magnetic field inductively coupled to said dry chamber crucible to induce the dry chamber material current and heat said dry chamber crucible with heat transfer from said dry chamber crucible producing said molten metal from said scrap metal;

means for run out of said molten metal from said dry chamber induction furnace; a wet chamber induction furnace for receiving said molten metal by said means for run out of said molten metal, said wet chamber induction furnace further comprising:

a wet chamber crucible for holding said molten metal, said wet chamber crucible formed substantially from a material having a high electrical resistivity or having a high magnetic permeability to limit the penetration depth of a wet chamber material current into said wet chamber crucible;

at least one wet chamber induction coil consisting of a cable wound of conductors isolated one from the other, said at least one wet chamber induction coil surrounding said wet chamber crucible and arranged to be connected to said at least one power supply; and an isolation sleeve to electrically and thermally insulate said wet chamber crucible from said at least one wet chamber induction coil; whereby a wet chamber magnetic field is generated by a second current in said at least one wet chamber induction coil; the at least one wet chamber induction coil connected to said at least one power supply; the wet chamber magnetic field inductively coupled to said wet chamber crucible to induce the wet chamber material current and heat said wet chamber crucible with heat transfer from said wet chamber crucible to heat said molten metal; and means for removal of said heavy metal inclusions from said dry chamber induction furnace.

15. The induction melting system of claim 14 wherein said dry chamber crucible and said wet chamber crucible are formed substantially from a silicon carbide or a high permeability steel.

16. The induction melting system of claim 14 wherein said isolation sleeves for said dry chamber induction furnace and said wet chamber induction furnace are a composite ceramic material.

17. The induction melting system of claim 16 wherein said composite ceramic material further comprises an air-bubbled ceramic disposed between at least one inner and at least one outer layer of ceramic.

18. The induction melting system of claim 14 wherein said at least one power supply and said at least one induction coils of said dry furnace induction furnace and said wet furnace induction furnace are air cooled.

19. The induction melting system of claim 14 wherein said at least one power supply is mounted adjacent to at least one of said induction coils, and wherein said at least one power supply, and said at least one induction coil of at least one of said dry chamber induction furnace and said wet chamber induction furnace, are air cooled.

20. The induction melting system of claim 19 wherein an airflow sequentially cools components of said at least one power supply and said at least one induction coil.

21. The induction melting system of claim 14 wherein said means for run out of said molten metal from said dry chamber induction furnace to said wet chamber induction furnace comprises a trough disposed in the bottom of said dry chamber induction furnace.

22. The induction melting system of claim 14 wherein said means for removal of said heavy metal inclusions comprises a hinged bottom in said dry chamber induction furnace.

23. The induction melting system of claim 22 wherein said means for removal of said heavy metal inclusions further comprises a cylinder supporting said hinged bottom to selectively open said hinged bottom and a slag bin to receive said heavy metal inclusions when said hinged bottom opens.

24. The induction melting system of claim 14 wherein said dry chamber induction furnace has a lid that includes an exhaust duct for exhausting fumes from heating said scrap metal.

25. The induction melting system of claim 14, further comprising a vibratory conveyor to place said scrap metal in said dry chamber crucible.

26. The induction melting system of claim 14 further comprising one or more additional wet chamber induction furnaces, and wherein said means for run out of said molten metal from said dry chamber induction furnace to said wet chamber furnace includes transfer means to transfer said molten metal from said dry chamber induction furnace selectively among said wet chamber induction furnace and said one or more additional wet chamber induction furnaces.

27. The induction melting system of claim 26 wherein said transfer means to transfer said molten metal from said dry chamber induction furnace selectively among said wet chamber induction furnace and said one or more additional wet chamber induction furnaces further comprises an adjustable launder.

28. The induction melting system of claim 26 wherein said dry chamber crucible is removable from said dry chamber induction furnace.

29. The induction melting system of claim 14 wherein said at least one power supply operates at a frequency selected to make the penetration depth into said dry chamber crucible of the dry chamber magnetic field and the penetration depth into said wet chamber crucible of the wet chamber magnetic field equal to approximately 1.2 times the thickness of said dry chamber crucible and said wet chamber crucible, respectively.

30. A method of separating a metal from a metal scrap containing heavy metal inclusions comprising the steps of:

placing said metal scrap in a dry chamber crucible formed substantially from a material of high electrical resistivity or high magnetic permeability;

inductively heating said dry chamber crucible by supplying current to at least one induction coil consisting of a cable wound of a magnitude of copper conductors isolated one from the other, said at least one induction coil surrounding said dry chamber crucible and electrically and thermally isolated from said dry chamber crucible;

melting said scrap metal into a molten metal from said metal scrap by the conduction of heat from said dry chamber crucible to said metal charge;

selectively running out said molten metal from said dry chamber crucible into one or more wet chamber crucibles formed substantially from a material of a high electrical resistivity or high magnetic permeability;

inductively heating one or more said wet chamber crucibles by supplying current to at least one induction coil consisting of a cable wound of a magnitude of copper conductors isolated one from the other, each of said one or more wet chamber crucibles being surrounded by and electrically and thermally isolated from at least one said induction coil; and heating said molten metal in said one or more wet chamber crucibles by the conduction of heat from said wet chamber crucibles to said molten metal charge.

31. The method according to claim 30 further comprising the step of removing said one or more wet chamber crucibles.

32. An induction furnace for forming a casting from a molten metal comprising;

at least one power supply;

a crucible for holding and heating said molten metal, said crucible formed substantially from a material having a high electrical resistivity or high magnetic permeability to limit the penetration depth of a material current into said crucible;

sealing means to seal the interior of said crucible;

at least one induction coil consisting of a cable wound of a magnitude of copper conductors isolated one from the other, said at least one induction coil surrounding said crucible, the material current being induced by a magnetic field generated by a current in said at least one induction coil, said current supplied by the at least one power supply and operating at a selected frequency;

an isolation sleeve to electrically and thermally isolate said crucible from said at least one induction coil;

a tube protruding through said sealing means, said tube having a first end emerged in said molten metal and a flanged end opposite said first end;

a mold disposed upon said flanged end, said mold having its gate aligned with the opening of said tube; and a port in said sealing means for injecting gas at a pressure into the interior of said crucible to exert a force against the surface of said molten metal in said crucible;

whereby said molten metal is forced through the opening in said tube and into the gate of said mold to fill the cavities within tile mold.

33. The induction furnace of claim 32 wherein said crucible is formed substantially from a silicon carbide or a high permeability steel.

34. The induction furnace of claim 32 wherein said isolation sleeve is a composite ceramic material.

35. The induction furnace of claim 34 wherein said composite ceramic material comprises an air-bubbled ceramic disposed between at least one inner and at least one outer layer of ceramic.

36. The induction melting system of claim 32 wherein said at least one power supply and said at least one induction coil are air cooled.

37. The induction melting system of claim 32 wherein said at least one power supply is mounted adjacent to said at least one induction coil.

38. The induction melting system of claim 37 wherein an airflow sequentially cools components of said at least one power supply and said at least one induction coil.

39. The induction furnace of claim 32 wherein the selected frequency of said at least one power supply results in the depth of penetration into said crucible of the magnetic field being approximately equal to 1.2 times the thickness of the crucible.

40. A method of casting a mold from a molten metal comprising the steps of:

placing said molten metal in a crucible formed substantially from a material of high electrical resistivity or high magnetic permeability;

sealing the interior of said crucible;

inductively heating said crucible by supplying current to at least one induction coil consisting of a cable wound of a magnitude of copper conductors isolated one from the other, said at least one induction coil surrounding said crucible and electrically and thermally isolated from said crucible;

heating said molten metal by the conduction of heat from said crucible to said molten metal;

positioning said mold on a flanged end of a tube protruding through said crucible to seat the gate of said mold over the opening in said flanged end;

immersing an end of said tube opposite said flanged end into said molten metal;

injecting gas into said crucible to pressurize the interior of said crucible and force molten metal through said tube and into said mold;

filling said mold with molten metal;

depressurizing said crucible; and removing said mold from said tube.

41. An induction melting system for providing a continuous supply of a molten metal comprising:

at least one power supply;

a crucible for holding and heating said molten metal, said crucible formed substantially from a material having a high electrical resistivity or high magnetic permeability selected to limit the penetration depth of a material current into said crucible;

sealing means to seal the interior of said crucible;

at least one induction coil consisting of a cable wound of a magnitude of copper conductors isolated one from the other, said at least one induction coil surrounding said crucible and having a current supplied from the at least one power supply to generate a magnetic field to create the material current;

an isolation sleeve to electrically and thermally isolate said crucible from said at least one induction coil;

an inlet conduit protruding through said sealing means, said inlet conduit having an exit end immersed in said molten metal and a receiver end opposite said exit end, said receiver end arranged to accept a continuous supply of feed material into said molten metal;

an outlet conduit protruding through said sealing means, said outlet conduit having a first end submerged in said molten metal and an exit end opposite said first end; and a port in said sealing means for injecting gas at a pressure into the interior of said crucible to exert a force against the surface of said molten metal in said crucible;

whereby said molten metal is continuously forced through said outlet conduit and out of said exit end of said outlet conduit.

42. The induction melting system of claim 41 wherein said outlet conduit forms a siphon to draw a continuous flow of said molten metal from said crucible without said force exerted against the surface of said molten metal in said crucible.

43. The induction melting system of claim 42 further comprising a port in said outlet conduit for injecting gas at a pressure into said outlet conduit to form a gas break in said continuous flow whereby said continuous flow is terminated.

44. The induction melting system of claim 41 wherein said crucible is formed substantially from a silicon carbide or a high permeability steel.

45. The induction furnace of claim 41 wherein said isolation sleeve is a composite ceramic material.

46. The induction furnace of claim 45 wherein said composite ceramic material comprises an air-bubbled ceramic disposed between at least one inner and at least one outer layer of ceramic.

47. The induction furnace of claim 41 wherein said at least one power supply and said at least one induction coil are air cooled.

48. The induction melting system of claim 41 wherein said at least one power supply is mounted adjacent to said at least one induction coil.

49. The induction melting system of claim 48 wherein an airflow sequentially cools components of said at least one power supply and said at least one induction coil.

50. The induction melting system of claim 41 wherein the selected frequency of said at least one power supply results in the depth of penetration into said crucible of the magnetic field being approximately equal to 1.2 times the thickness of the crucible.

51. A method of continuously providing a continuous supply of a molten metal comprising the steps of:

continuously supplying a feed material into a sealed crucible formed substantially from a material of high electrical resistivity or high magnetic permeability;

inductively heating said crucible by supplying current to at least one induction coil consisting of a cable wound of a magnitude of copper conductors isolated one from the other, said at least one induction coil surrounding said crucible and electrically and thermally isolated from said crucible;

heating said feed material by the conduction of heat from said crucible to said molten metal; and partially immersing an outlet conduit in said molten metal for continuously drawing molten metal from an exit opening in said outlet conduit protruding from the enclosed crucible.

52. The method of claim 51 further comprising the step of continuously injecting a gas at a pressure into said sealed crucible to continuously force molten metal through the exit opening in said outlet conduit.

53. The method of claim 52 further comprising the step of injecting a gas at a pressure into said sealed crucible to initiate a continuous siphoning of molten metal through said outlet conduit.

54. The method of claim 53 further comprising the step of injecting a gas at pressure into said outlet conduit to interrupt said continuous siphoning of molten metal.

55. A process for heating a metal comprising the steps of:

placing said metal in a container formed substantially from a material of high electrical resistivity or high magnetic permeability;

inductively heating said container by supplying a fast current of a selected frequency to at least one induction coil consisting of a cable wound of multiple conductors isolated from each other, said at least one induction coil surrounding said container and being electrically and thermally isolated from said container by an isolation sleeve;

adjusting said current so that the penetration depth of an induced current into the container is in the range of from half the thickness to the thickness of the container, the induced current being induced by a magnetic field generated by said first current; and heating said metal by the conduction of heat from said container to said metal.

56. The method of claim 55, wherein said container is formed substantially from a silicon carbide or a high permeability steel.

* * * * *